US005276335A

United States Patent [19]

Shinopulos et al.

[11] Patent Number: 5,276,335

[45] Date of Patent: Jan. 4, 1994

[54] CASK FOR STORING AND TRANSPORTING HIGHLY RADIOACTIVE MATERIAL AND METHOD OF MAKING SAME

[75] Inventors: George Shinopulos, Burlington; Peter R. Roberts, Groton, both of Mass.

[73] Assignee: Nuclear Metals, Inc., Waltham, Mass.

[21] Appl. No.: 818,050

[22] Filed: Jan. 8, 1992

[51] Int. Cl.[5] ..... G21F 5/00

[52] U.S. Cl. ..... 250/506.1; 250/515.1

[58] Field of Search ..... 250/506.1, 502.1, 515.1, 250/517.1, 518.1, 519.1; 376/272

[56] References Cited

U.S. PATENT DOCUMENTS

| | | | |
|---|---|---|---|
| 4,147,938 | 4/1979 | Heckman et al. | 250/506.1 |
| 4,272,683 | 6/1981 | Baatz et al. | 250/506.1 |
| 4,868,400 | 9/1989 | Barnhart et al. | 250/506.1 |
| 4,914,306 | 4/1990 | Dufrane et al. | 250/506.1 |

*Primary Examiner*—Constantine Hannaher
*Assistant Examiner*—Kiet T. Nguyen
*Attorney, Agent, or Firm*—Joseph S. Iandiorio

[57] ABSTRACT

A cask for storing and transporting highly radioactive materials includes an inner shell and a number of layers of depleted uranium wire wound on the inner shell to create a radioactive shield against emanation of radioactivity from the material stored within the inner shell.

41 Claims, 5 Drawing Sheets

CASK FOR STORING AND TRANSPORTING HIGHLY RADIOACTIVE MATERIAL AND METHOD OF MAKING SAME

FIELD OF INVENTION

This invention relates to an improved container and a method of making such a container for storing and transporting highly radioactive material.

BACKGROUND OF INVENTION

Nuclear reactors generate substantial amounts of radioactive waste material in the form of spent fuel rods which are still highly radioactive. Special containers or casks are needed to transport them to preprocessing plants or for storing them. These casks must act as shields against radioactivity and must be structurally strong and sound as well as inexpensive as possible. Lead is well known to be a good shield against radioactivity but lead is too soft for secure fabrication and fastening. Depleted uranium is better and the shielding material of choice. It is cast into the desired shape and then sandwiched between steel or other structural members to provide the necessary strength and rigidity for the cask. However, castings suffer from voids due to cracks, gas holes, shrink holes and the like, which results in less than the specified thickness of depleted uranium for shielding. In addition, the large castings required are in the range of fifty to sixty thousand pounds while the largest uranium furnaces in current operation have typically no more than a five to six thousand pound capacity. As a result, the casks must be cast in pieces and then securely fastened together in such a way as to not only provide a rigid, unitary container but also so as to provide no clear, unshielded line of sight path through the cask along which radiation could escape.

SUMMARY OF INVENTION

It is therefore an object of this invention to provide an improved container or cask and a method of making such a cask for storing and transporting highly radioactive material.

It is a further object of this invention to provide such an improved cask and method which eliminates voids, cracks, gas holes, shrink holes and the like normally occurring in cast forms.

It is a further object of this invention to provide such an improved cask and method which eliminates the need for casting the depleted uranium shield portions.

It is a further object of this invention to provide such a cask and method which assures ample uniform thickness of the depleted uranium shield.

It is a further object of this invention to provide such a cask and method which enables a single continuous construction for the depleted uranium shield portions.

It is a further object of this invention to provide such a cask and method in which the depleted uranium shield can be easily shaped to any desired form.

It is a further object of this invention to provide such a cask and method which requires no large capital investment in melting furnaces or casting dies.

It is a further object of this invention to provide such a cask and method which permits testing of shielding before final fabrication.

It is a further object of this invention to provide such a cask and method which enables effective X-ray or ultrasonic examination of the shielding.

It is a further object of this invention to provide such a cask and method which enables dynamic, high-speed X-ray or ultrasonic examination of the shielding.

The invention results from the realization that a truly effective cask for storing and transporting highly radioactive materials can be constructed by using depleted uranium in the form of wire, of various cross-sectional shapes, wound to form a continuous shield for the body of the cask and also for the end caps.

This invention features a cask body for storing and transporting highly radioactive materials. There is an inner shell and a number of layers of depleted uranium wire wound on the inner shell to create a radioactive shield against emanation of radioactivity from material stored within the inner shell.

In a preferred embodiment the inner shell may be cylindrical or polygonal, the wire may be round, rectangular or polygonal, and the the wire may be wound tensilely stressed onto the inner shell for applying a compressive stress on the inner shell. The wire layers may be staggered to minimize overlap of joints from layer to layer and they may be wound circumferentially on the inner shell.

The invention also features a cask body for storing and transporting highly radioactive materials, including an inner shell, a number of layers of depleted uranium wire wound on the inner shell to create a radioactive shield against emanation of radioactivity from materials stored within the inner shell, and an outer shell spaced from the inner shell, and covering and protecting the depleted uranium wire. The outer and inner shells may be fixed together to form a single unitary structure, and the outer shell may have the same shape as the inner shell.

The invention also features a cask for storage and transport of highly radioactive materials including a cask body having an inner shell and a number of layers of depleted uranium wire wound on the inner shell to create a radioactive shield against emanation of radioactivity from material stored within the inner shell. There are also a base member for capping each end of the body. Each of the base and cover members includes an inner plate and a number of layers of depleted uranium wire wound on the inner plate to create a radioactive shield against emanation of radioactivity from materials stored within the cask. The inner plate may include a depleted uranium plug, and the depleted uranium wire may be wound spirally or circumferentially about the plug. The plug may be tapered to automatically induce a staggering in the joints between the wire from layer to layer. The cover and base members may include outer plates spaced from their inner plates and covering and protecting the depleted uranium wire wound on the inner plates.

The invention also features a method of making a cask body for storing highly radioactive materials, including the steps of providing an inner shell having the shape of the storage cavity for the radioactive material to be stored, and winding a plurality of layers of depleted uranium wire on the inner shell to create a radiation shield against emanation of radioactivity from materials stored within the inner shell.

In a preferred embodiment, the shell may be cylindrical, polygonal or any other shape, and the wire may be round, rectangular, polygonal or any other shape. The wire may be wound tensilely stressed onto the shell for applying compressive stress on the inner shell, the wire layers may be staggered to minimize overlap of joints from layer to layer, and the wire may be circumferentially wound on the inner shell. The method may include adding an outer shell spaced from the inner for covering and protecting the depleted uranium wire. The outer shell may be joined to the inner shell to form a single unitary structure. The outer shell may have the same shape as the inner shell.

The method may also include in a preferred embodiment constructing a base member and a cover member for capping each end of the body by winding for each member a number of layers of depleted uranium wire on an inner plate to create a radioactive shield against emanation of radioactivity from materials stored within the cask. The inner plate may be provided with a depleted uranium plug, and the depleted uranium wire may be spirally or circumferentially wound about the plug. An outer plate may be added to each member spaced from the inner plate for covering and protecting the depleted uranium wire. The plug may be tapered to automatically induce staggering of the joints between the wires from layer to layer.

BRIEF DESCRIPTION OF THE DRAWINGS

Other objects, features and advantages will occur to those skilled in the art from the following description of a preferred embodiment and the accompanying drawings, in which.

DETAILED DESCRIPTION OF THE PREFERRED EMBODIMENTS

Figure 1:
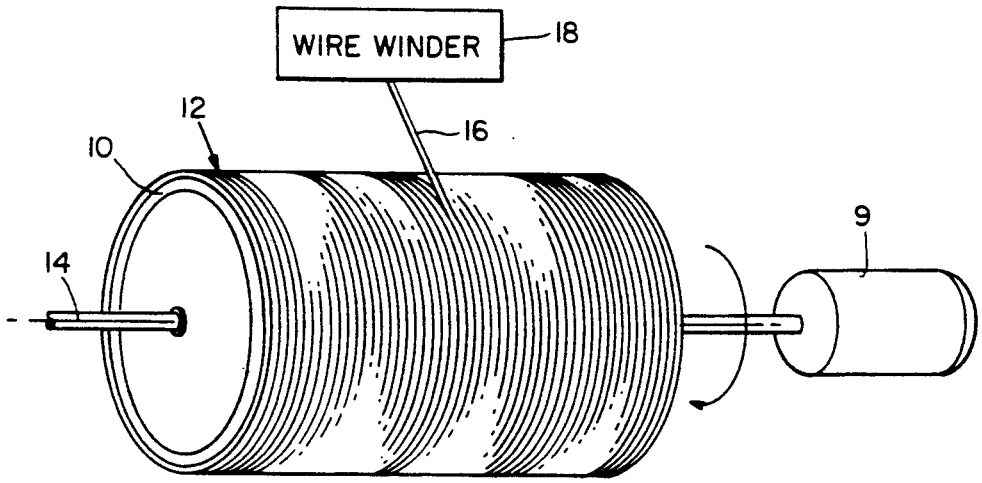
FIG. 1 is a schematic diagrammatic view with parts in three dimension of a cask body having wound on it layers of depleted uranium wire.

A cask body for storing and transporting highly radioactive materials according to this invention may be accomplished using an inner shell which can be made of steel or similar structurally strong material, with a number of layers of depleted uranium wire circumferentially wound on the inner shell to create a radioactive shield against emanation of radioactivity from materials stored within the inner shell. The wire can be wound tightly, tensilely stressed onto the inner shell to apply a compressive stress on the inner shell, thereby increasing its strength and durability. The shield itself may be a few inches thick and the cask may be six or more feet in diameter and six or more feet high for typical applications.

A casting of depleted uranium in a copper jacket (to prevent rapid oxidation) is hot worked such as in a looping mill, into an intermediate diameter, for example from ⅜ to 5/16 inch. It is then cold drawn to a final size and shape, for example a round cross section with a diameter of ⅛ to 1/16 inch, or a rectangular cross section of 1/10 to ¼ inch. This wire may then be used to create the wire wound depleted uranium shield. If there is a large transition from the hot working size to the cold drawn size, further heat treating may be used to soften the metal and then final shaping through cold drawing may be effected. After this, the depleted uranium wire can be used to wind cylindrical or spiral shields for the cask body cover and base members according to this invention to form a completed cask.

The hot working eliminates and heals voids, cracks and holes that might normally occur in cast material. It also recrystallizes the structure from cast dendrites to regular crystalline wrought material which is more ductile and tougher. By using wire to form the shield instead of castings, any desired shape can be fabricated without the requirement for new casting molds. In this way large capital investment for melting and casting dies and furnaces is eliminated. In addition, the wire wound shield creates a single continuous structure (without the added cost and complexity of designing joints for castings) which will not only be structurally sound but will avoid leakage of radioactive radiation. The final wire form can be round, square, flat, hexagonal, or any polygonal shape. Even round wire with its inherent voids can be used by simply adding additional layers to compensate for the total void, so that the total length of the path through the shielding material is sufficient to attenuate the radiation. The voids may be minimized by running the wire in the same direction from layer to layer: that is, in a left-hand helix or a right-hand helix continuously. A further advantage of using wire is that the quality of the shielding can be tested before the cask is complete. Delaying inspection until after the completion of the cask introduces two problems. The expense of fabricating the device has already been endured before it is known whether the quality is acceptable. In addition, once the shielded cask is completed it is difficult to inspect in the typical manner using X-rays since it is an effective shielding device. By using a wire-wound shield, there is provided the opportunity to inspect the wire before it is wound into a shield. This can be done very quickly "on the fly" as the wire goes past an inspection station, and since the wire is quite thin, X-rays or ultrasonics can be effectively used to determine its uniformity and structure. Although the wire has been disclosed to herein as being drawn to size, it may as well be done by other techniques, such as by rolling for example. When the wire is wound into the shield, the layers are staggered so that the joints between the wire do not overlap and create an escape path for the radiation.

The cask body can contain an outer shell spaced from the inner shell to cover and protect the depleted uranium. The outer shell may be the same shape as the inner shell, and it may be fixed to the inner shell to form a single unitary body with superior strength and rigidity containing the depleted uranium wire-wound shield between the two shells. The cask may be completed by a base member and a cover member which caps each end of the body. Each of the members can include an inner plate and a number of layers of depleted uranium wire wound on the inner plate to create a radioactive shield against emanation of radioactivity from the material stored within the cask. A depleted uranium plug may be used on each inner plate as the central point on which the depleted uranium wire is wound, either spirally or circumferentially about the plug. The base and cover members may include outer plates spaced from the inner plates and covering and protecting the depleted uranium wire. The depleted uranium plug can be tapered so that it automatically induces a staggering of the joints between the wire from layer to layer to avoid escape paths through which the radiation can escape.

There is shown in FIG. 1 the inner shell 10 of a cask body according to this invention on which is wound circumferentially a shield 12 of depleted uranium wire. As shell 10 is rotated about its central axis 14, the depleted uranium wire 16 is wound on it by a wire-winding machine 18 of conventional design in the same manner as wire would be wound on a conventional wire or cable bobbin or reel. As wire 16 is cast back and forth across shell 10 rotated by drive 9, the wire is wound circumferentially, first in a left-hand helix, then in a right-hand helix. However, alternatively, wire winder 18, a wire winding traversing mechanism, is operated to stop and rewind only in the same direction: that is, always in a left-hand spiral or always in a right-hand spiral. When this is accomplished, the strands of round wire will lie within the joints between the wires of subordinate layers so as to minimize the voids between them.

Figure 2:
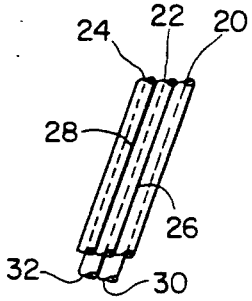
FIG. 2 is a top view of two layers of wire wound in the same direction on a cask body such as shown in FIG. 1.
Figure 3:
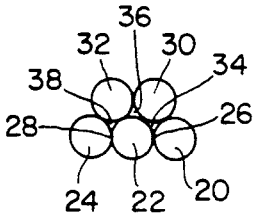
FIG. 3 is an end view of the wires in FIG. 2 showing the voids created between the circular wires.
Figure 4:
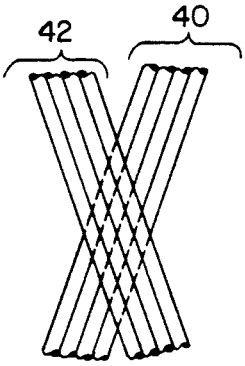
FIG. 4 is a top schematic view similar to FIG. 2 showing the propensity for increased voids when the layers are wound in alternate left-hand and right-hand fashion.

Thus in FIG. 2, where the wire has been laid in a left-hand helix, wire strands 20, 22 and 24 of the lower layer, shown in full lines, create gaps at joints 26 and 28. When the next layer is applied, strands 30 and 32, shown in phantom, will lie over joints 26 and 28, minimizing the voids 34, 36, 38 shown in FIG. 3. If the layers were applied in a more conventional manner, first in a left-hand helix then in a right-hand helix, the strands would crisscross as shown in FIG. 4, where the strands of the lower layer 40 slant to the left and the strands of the the upper layer 42 slant to the right.

Figure 5:
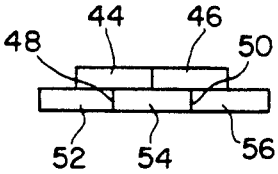
FIG. 5 is a schematic diagrammatic end view of rectangular or flat wire wound to stagger the joints between the wire from layer to layer.
Figure 6A:
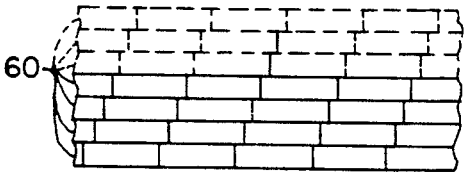
FIG. 6A is a schematic diagrammatic end view of a plurality of layers of flat wire showing the proportion of offset required to produce staggering that avoids line of sight paths through the wire layers.
Figure 6B:
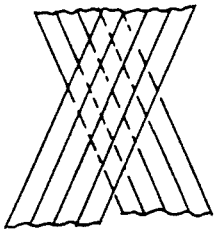
FIG. 6B is a schematic diagrammatic top view showing that adjacent layers of flat wire wound in opposite directions additionally have their joints angled to each other, thereby further inhibiting alignment of joints.
Figure 7:
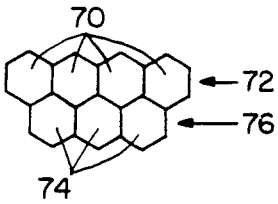
FIG. 7 is an end view of a portion of two layers of hexagonal wire.

The voids can be eliminated in a number of ways. For example, the wire can be made square, rectangular, or flat as indicated in FIG. 5, where the strands 44 and 46 in the upper layer are staggered so that they cover the joints 48 and 50 created between strands 52, 54 and 56. While in FIG. 5 the overlap of the two layers is shown to be 50%, the actual amount of overlap is adjusted for the number of layers and the diameter of the wire. For example, in FIG. 6, a number of layers 60 far in excess of two can be applied to build the shield since the overlap is in the range of only 1 or 2%. By winding alternately and continuously from left to right and right to left, in FIG. 6B, adjacent layers of wire have their joints angled to each other, thereby additionally inhibiting joint alignment. Other shapes of wire also eliminate voids. For example the hexagonal wires 70 in the upper layer 72, FIG. 7, nest without voids in the junctions formed by hexagonal strands 74 in the lower layer 76. The completed cask body 11, FIG. 8, is shown having a cylindrical outer shell 82 matching in shape cylindrical inner shell 10 and welded to it at junctions 84 and 86 to form a single unitary structure with four-layer wire-wound depleted uranium shield 12 between them.

Figure 9:
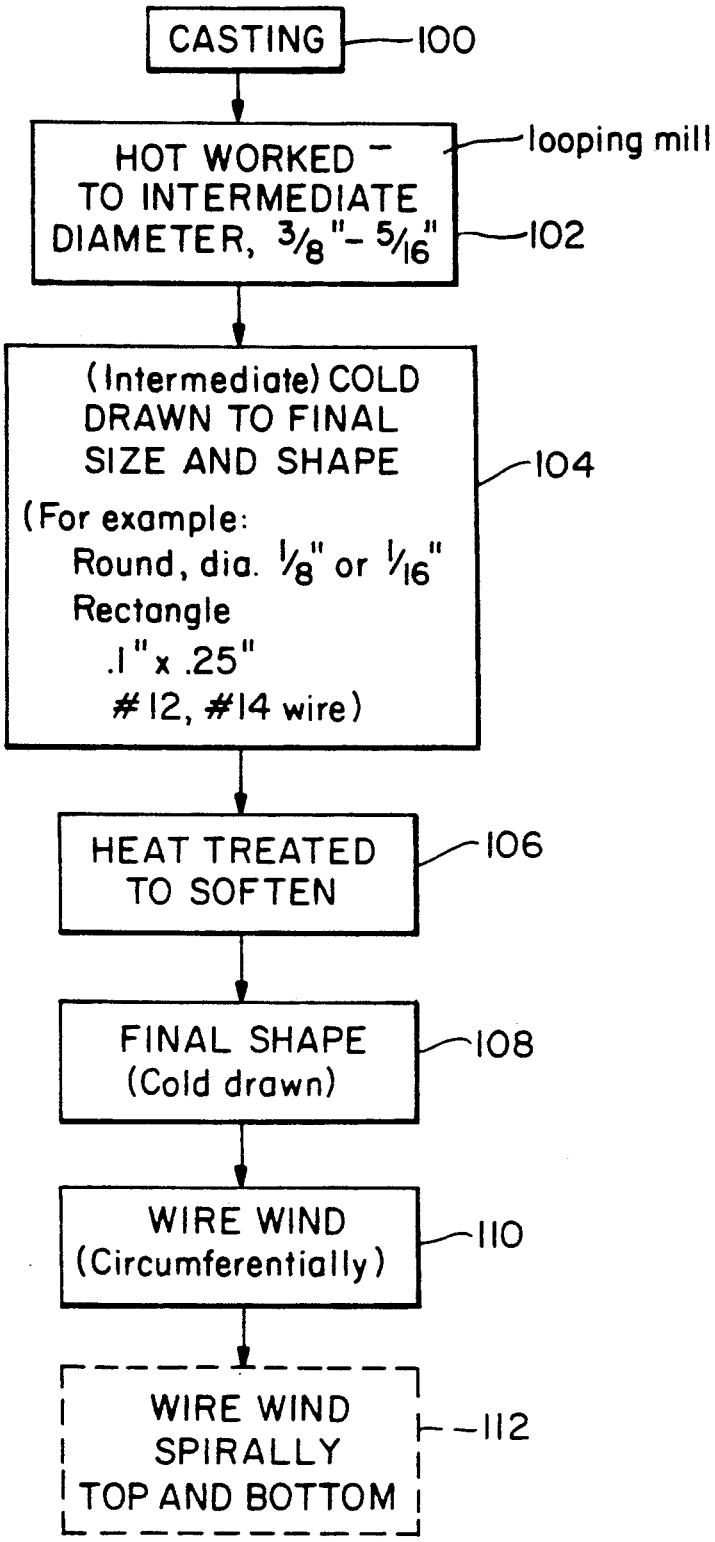
FIG. 9 is a block diagram illustrating a method of making and winding the wire according to this invention.

The method of fabricating cask body 11 includes casting an ingot 100, FIG. 9, of depleted uranium. Then in step 102, hot working the depleted uranium into a rod or wire of material of a diameter from ⅜ to 5/16 inch, for example, in an extrusion press such as a 1400 ton Loewy hydropress or a grooved roll rod rolling mill. Following this in step 104, the wire or rod is cold drawn to a final size and shape such as a round wire with a diameter of ⅛ to 1/16 inch or a rectangular wire 1/10 by ¼ inch. Since the drop in size between the hot working and the cold drawing is substantial, a further heat treatment may be provided in step 106 to soften the depleted uranium wire, after which a final shaping by cold drawing can be accomplished in step 108. Following this, in step 110, the wire may be wound circumferentially about inner shell 10 and then circumferentially or spirally wound in step 112 on a plate to form the cover and base members.

Figure 8:
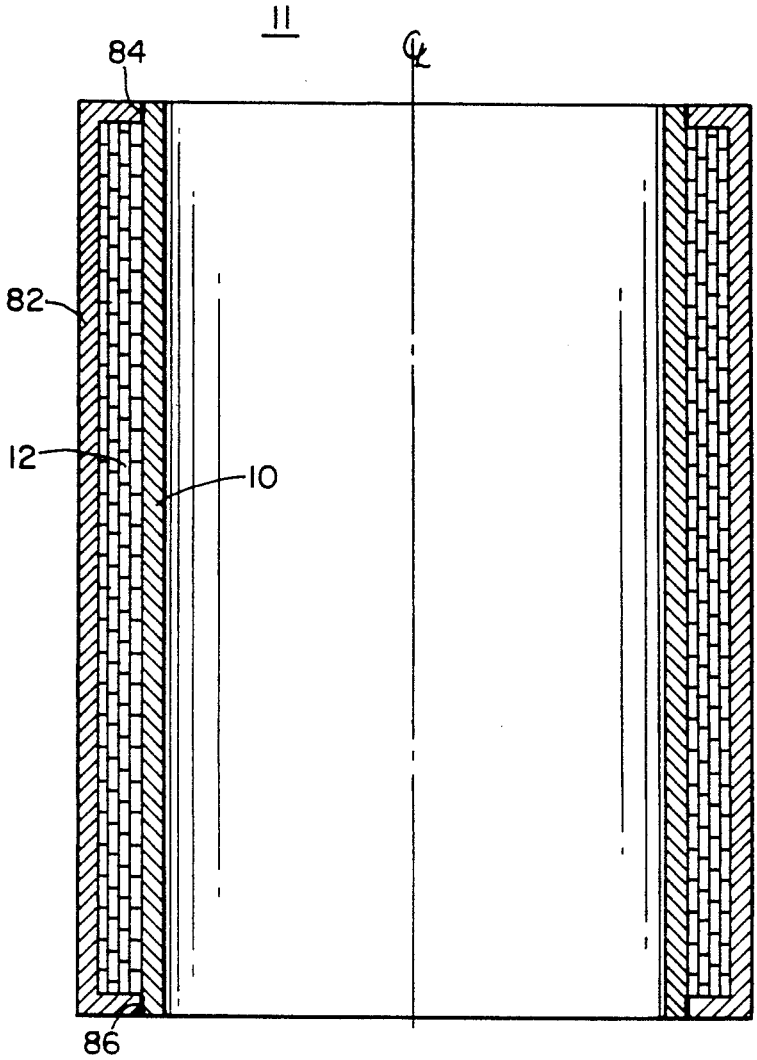
FIG. 8 is a side elevational view of a cylindrical cask body with a depleted uranium shield made from rectangular or flat wire.
Figure 10:
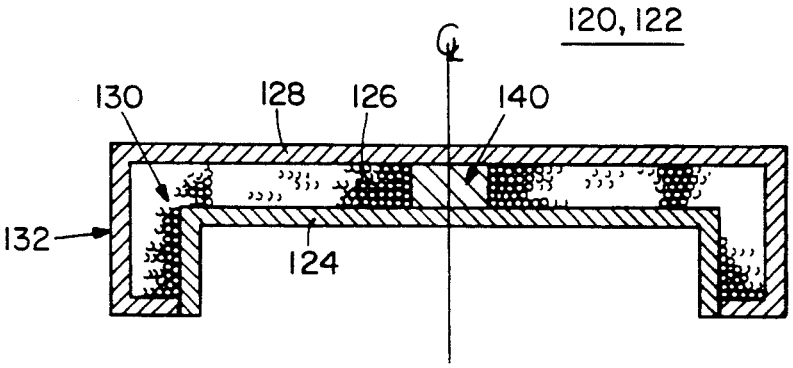
FIG. 10 is a schematic diagrammatic cross-sectional view of a cover or base according to this invention with a depleted uranium wire wound about a central depleted uranium plug.
Figure 11A:
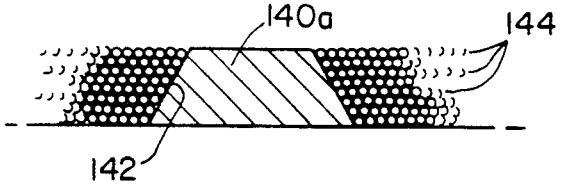
FIGS. 11A, 11B and 11C are cross-sectional views of alternative forms of the depleted uranium plug as shown in FIG. 10, with the sides tapered to automatically induce staggering of the joints between the wire from layer to layer.
Figure 11B:
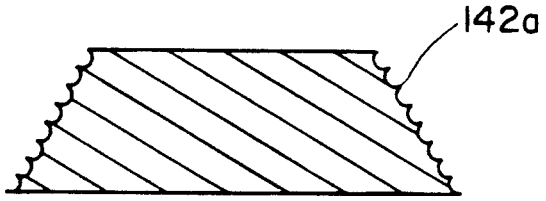
Figure 11C:
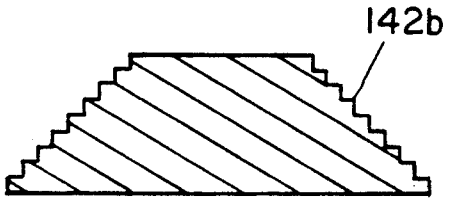
Figure 12:
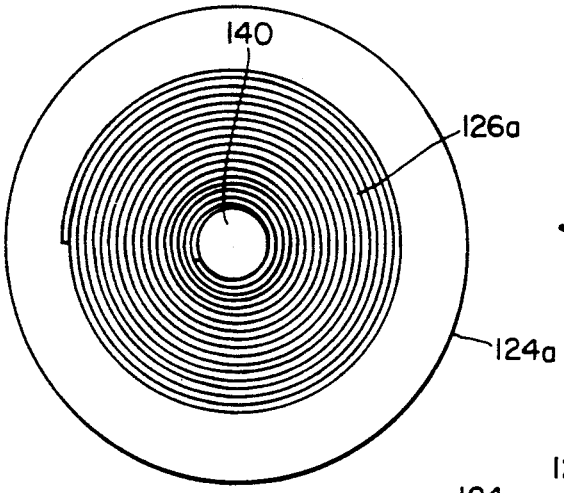
FIG. 12 is a top view of a partially completed layer of spirally or lay-up wound depleted uranium wire about a central uranium plug.
Figure 13:
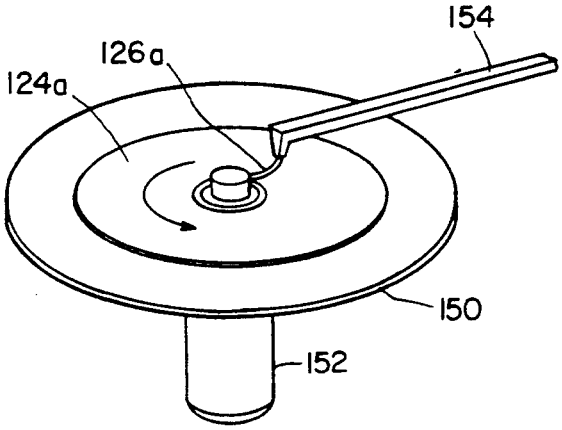
FIG. 13 is a schematic diagram of a device for providing the spiral winding shown in FIG. 12.

End caps, which may take the form of identically fabricated base member 120 and cover member 122, may be used to close the ends of cask body 11, FIG. 8. Each such member, as shown in FIG. 10, includes an inner plate 124 on which is wound spirally, circumferentially or both, a number of layers of depleted uranium wire. An outer plate 128 may be fixed to inner plate 124 to form a protective covering over the depleted uranium wire 126 which constitutes radioactivity shield 130. An annular wall is provided by inner plate 124 and outer plate 128 complete with shielding 130 in order to complete the closure of cask body 11 and eliminating any possible line of sight escape paths for radiation. A depleted uranium plug 140 may be used at the center of members 120, 122 to form a center point about which the wire may be wound. Plug 140 may be formed with tapered wall 142 as shown in FIG. 11 with respect to plug **140*a*. The taper is set so that each successive layer of wire windings 144 is offset with respect to the others so that no direct line of sight through junctions is permitted. In order to remove potential line of sight leakage along tapered wall 142, that wall can be formed with a helical, curved groove 142*a*, FIG. 11B, for circular wire, or a stepped surface 142*b*, FIG. 11C, for wire with a rectilinear cross-section. The spiral winding of depleted uranium wire 126*a* about plug 140 on inner plate 124*a* as shown in FIG. 12 can be accomplished by a spiral winding device which includes a drive table 150, FIG. 13, driven by drive system 152 to rotate inner plate 124a while wire 126a is fed through a radially traversing feeder arm 154** in a conventional way.

Figure 14:
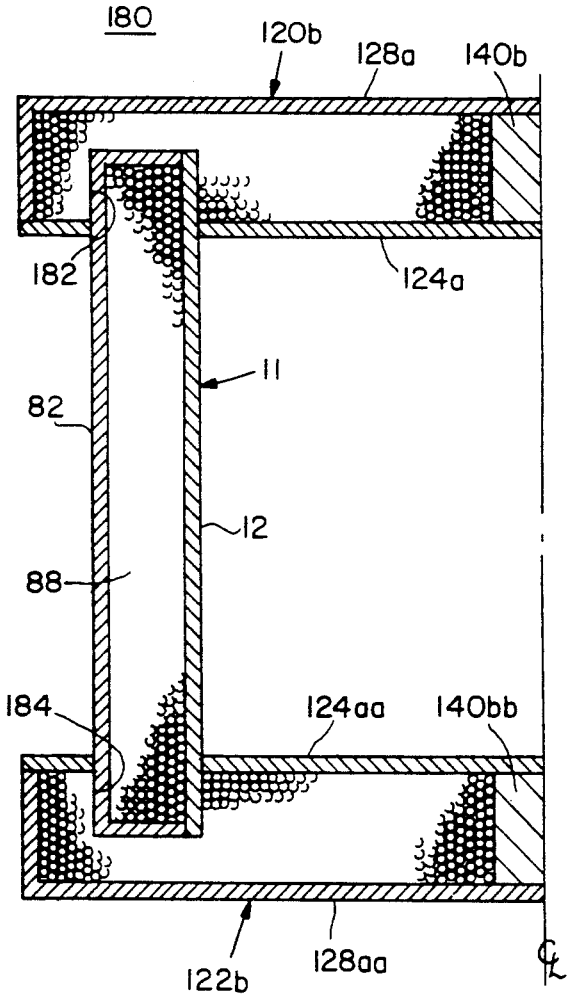
FIG. 14 is a schematic diagrammatic side elevational sectional view of a cask according to this invention with an alternative form of cover and base member.

Completed cask 180, FIG. 14, is shown including cask body 11 with cover member 120b and base member 122b installed on it. In this embodiment, cover member 120b and base member 122b each include an annular recess 182, 184 which overlaps and engages the ends of cask body 11.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A cask body for storing and transporting highly radioactive materials includes:

an inner shell; and a number of layers of depleted uranium wire wound on the inner shell to create a radioactive shield against emanation of radioactivity from the material stored within the inner shell, said wire wound layers are alternately and continuously wound from left to right and right to left on adjacent layers so that the wire joints are angled to each other to additionally inhibit joint alignment.

2. The cask body of claim 1 in which said layers are circumferentially disposed on said inner shell.

3. The cask body of claim 1 in which said inner shell is cylindrical.

4. The cask body of claim 1 in which said inner shell is polygonal.

5. The cask body of claim 1 in which said wire is round.

6. The cask body of claim 1 in which said wire is rectangular.

7. The cask body of claim 1 in which said wire is polygonal.

8. The cask body of claim 1 in which said wire layers are staggered to minimize overlap of joints from layer to layer.

9. A cask body for storing and transporting highly radioactive materials comprising:

an inner shell; and a number of layers of depleted uranium wire wound on the inner shell to create a radioactive shield against emanation of radioactivity from the material stored within the inner shell, said wire wound layers are alternately and continuously wound from left to right and right to left on adjacent layers so that the wire joints are angled to each other to additionally inhibit joint alignment; and an outer shell spaced from said inner shell covering and protecting said depleted uranium wire.

10. The cask body of claim 10 in which said layers are circumferentially disposed on said inner shell.

11. The cask body of claim 10 in which said inner shell is cylindrical.

12. The cask body of claim 10 in which said inner shell is polygonal.

13. The cask body of claim 10 in which said wire is round

14. The cask body of claim 10 in which said wire is rectangular.

15. The cask body of claim 10 in which said wire is polygonal.

16. The cask body of claim 10 in which said outer shell is cylindrical.

17. The cask body of claim 10 in which said wire layers are staggered to minimize overlap of joints from layer to layer.

18. The cask body of claim 10 in which said outer shell is fixed to said inner shell to form a single unitary structure.

19. The cask body of claim 10 in which said outer shell has the same shape as said inner shell.

20. A cask body for storage of highly radioactive materials comprising:

said cask body including an inner shell;

a number of layers of depleted uranium wire wound on the inner shell to create a radioactive shield against emanation of radioactivity from the material stored within the inner shell; and a base member and a cover member for capping each end of said body, said each member including an inner plate and a number of layers of depleted uranium wire wound on said inner plate to create a radioactive shield against emanation of radioactivity from the materials stored within the cask.

21. The cask of claim 20 in which said wire is disposed circumferentially on said inner shell.

22. The cask of claim 20 in which said inner plate includes a depleted uranium plug and said depleted uranium wire is disposed spirally about said plug.

23. The cask of claim 20 in which said inner plate includes a depleted uranium plug and said depleted uranium wire is disposed circumferentially about said plug.

24. The cask of claim 23 in which said plug is tapered to automatically induce a staggering of the joints between the wire from layer to layer.

25. The cask of claim 20 in which said each member includes an outer plate spaced from said inner plate covering and protecting said depleted uranium wire.

26. The cask body of claim 20 in which said wire wound layers are alternately and continuously wound from left to right and right to left on adjacent layers so that the wire joints are angled to each other to additionally inhibit joint alignment.

27. A method of making a cask body for storing highly radioactive materials, comprising:

providing an inner shell having the shape of the storage cavity for the radioactive material to be stored;

providing an inner shell having the shape of the storage cavity for the radioactive material to be stored;

winding a plurality of layers of depleted uranium wire on said inner shell to create a radioactive shield against emanation of radioactivity from materials stored within the inner shell; and constructing a base member and a cover member for capping each end of said body by winding, for each member including an inner plate and an outer plate, a number of layers of depleted uranium wire on the inner plate to create a radioactive shell against emanation of radioactivity from materials stored within the cask.

28. The method of claim 27 in which said wire is wound circumferentially on said inner shell.

29. The method of claim 27 in which said inner shell is cylindrical.

30. The method of claim 27 in which said inner shell is polygonal.

31. The method of claim 27 in which said wire is round.

32. The method of claim 27 in which said wire is polygonal.

33. The method of claim 27 in which said inner shell is cylindrical.

34. The method of claim 27 in which said wire layers are staggered to minimize overlap of joints from layer to layer.

35. The method of claim 27 including adding an outer shell spaced from said inner shell for covering and protecting said depleted uranium wire.

36. The method of claim 35 in which said outer shell is fixed to said inner shell to form a single unitary structure.

37. The method of claim 35 in which said outer shell has the same shape as said inner shell.

38. The method of claim 27 in which the inner plate is provided with a depleted uranium plug and said depleted uranium wire is spirally wound about said plug.

39. The method of claim 38 in which said plug is tapered to automatically induce a staggering of the joints between the wires from layer to layer.

40. The method of claim 27 in which the inner plate is provided with a depleted uranium plug and said depleted uranium wire is circumferentially wound about said plug.

41. The method of claim 27 in which each said member outer plate is spaced from said inner plate covering and protecting said depleted uranium wire.

* * * * *

UNITED STATES PATENT AND TRADEMARK OFFICE

CERTIFICATE OF CORRECTION

PATENT NO. : 5,276,335

DATED : January 4, 1994

INVENTOR(S) : George Shinopulos, et al

It is certified that error appears in the above-indentified patent and that said Letters Patent is hereby corrected as shown below:

On the title page: item [73] Assignee should read --Nuclear Metal, Inc., Concord Mass.

Signed and Sealed this

Sixteenth Day of August, 1994

*Attest:*

*Attesting Officer*

Bruce Lehman

BRUCE LEHMAN

*Commissioner of Patents and Trademarks*